US005385072A

United States Patent [19]

Neff

[11] Patent Number: 5,385,072

[45] Date of Patent: Jan. 31, 1995

[54] ADJUSTABLE GRIPPING AND LOCKING TOOL

[76] Inventor: Ted Neff, 24701 Raymond Way, #115, Lake Forest, Calif. 92630

[21] Appl. No.: 96,509

[22] Filed: Jul. 22, 1993

[51] Int. Cl.[6] ..... B25B 7/04

[52] U.S. Cl. ..... 81/405; 81/363; 81/356

[58] Field of Search ..... 81/355, 356, 359, 363, 81/405

[56] References Cited

U.S. PATENT DOCUMENTS

| | | | |
|---|---|---|---|
| 2,320,303 | 5/1943 | Ross | 81/356 |
| 2,481,435 | 9/1949 | Meunier | 81/356 |
| 2,618,188 | 11/1952 | Emmett | 81/356 |
| 3,208,319 | 9/1965 | Westby et al. | 81/367 |
| 3,793,914 | 2/1974 | Helms | 81/378 |
| 4,478,114 | 10/1984 | Arena | 81/363 |

*Primary Examiner*—James G. Smith

[57] ABSTRACT

An adjustable gripping and locking tool having a body (28) to which is attached an elongated handle (22) and a pivoting handle (26). An adjustable jaw (34) is slidably mounted on the body and an adjusting lever (52) cooperates with the adjustable jaw to adjust it toward and away from a fixed jaw (24). The adjusting lever is attached to the pivoting handle and is operated with the hand holding the tool, as is the locking and unlocking operation. The construction of the tool permits the adjustment of the jaws directly against the work piece and eliminates the tedious and time-consuming operation of turning a threaded screw back and forth several times to effect an adjustment that will permit the jaws to be locked on an object.

15 Claims, 1 Drawing Sheet

ADJUSTABLE GRIPPING AND LOCKING TOOL

BACKGROUND OF THE INVENTION

1. Field of the Invention

This invention relates to hand tools in general, and more specifically to a gripping and locking plier or wrench of the vise-grip class.

2. Related Art

This invention is an improvement over the hand tools contained in a number of prior patents, the most predominant and successful being that of Petersen, U.S. Pat. No. 2,280,005, issued Apr. 14, 1942. This tool was called a vise-grip and has been on the market for over 50 years without any serious challenge as to its manner of construction and operation.

The vise-grip tool and various copies of it have several disadvantages, however, and many attempts have been made to eliminate these disadvantages but to date there has been little, if any, success in doing so.

The most serious problem has to do with the adjustment of the jaws to a work piece prior to locking. In order to understand the problem, one must first understand how the jaws are adjusted in the original Petersen tool, which is still used today. The adjustment mechanism includes a manually operated threaded screw that is turned clockwise to open the jaws wider and counterclockwise to narrow the jaw opening. This screw extends axially inside an elongated hollow handle and has a knurled head protruding from the end of the handle, and the other end of the screw contacting one end of a fulcrum bar which is attached at its opposite end to a pivotable locking lever, or pivoting handle as it will be called herein for purposes of simplicity, and which in turn is attached to an adjustable jaw. The adjustable jaw pivots toward or away from a fixed jaw on the fixed handle. To adjust the tool to a work object, it is held in one hand while the other hand turns the screw head, thereby pivoting the adjustable jaw in a scissor-like fashion either toward or away from the fixed jaw. In order for the jaws to be locked on a work piece, the position of the adjustable jaw is very limited and critical to the locking operation as both jaws cannot be put into contact with the work piece at the same time and still be able to lock them. If such contact is made, they are too close for the lock to be activated; and by the same token, if the adjustable jaw is too far away from the work piece, the jaws still cannot be locked on the work. Therein lies the problem. In order to obtain this critical adjustment of the pivotable jaw, the adjusting screw must usually be adjusted several times before the proper adjustment can be achieved. This fine adjustment is required to lock the jaws every time a different sized work piece is involved.

A second disadvantage is that both hands must be used in order to adjust the tool so that it may be locked on a work piece as described above.

A third disadvantage is that both hands must also be used to release the jaws from a locked position, and if the lock is very tight, the release trigger becomes very difficult to operate. When it finally is activated, the handles will fly apart with considerable force and with possible injury to the operator.

A fourth disadvantage is that the adjustable jaw pivots in an arc and "scissors" as is mentioned above instead of moving in a linear direction. As a result, there is only one point at each adjusted position where the jaws are actually parallel to effect the best grip on a work piece, and it also limits the range of the jaw gap.

Still another disadvantage is the fact that when a vise-grip type tool is adjusted to where the adjustable jaw is at or near its most wide open point, the fixed handle and pivoting handle are so far apart as to be unreachable for the span of an average hand, again requiring the second hand to assist in bringing them together.

SUMMARY OF THE INVENTION

Accordingly, several objects and advantages of my invention are:

(1) To provide an adjustable gripping and locking tool wherein the jaws can be adjusted quickly and easily directly against a work piece, with such adjustment producing a light or heavy grip at the choice of the operator, the adjustment being accomplished in just one move of the thumb of the hand holding the tool;

(2) to provide such a tool as in (1) above that has constantly parallel jaws that do not "scissor" during the adjustment operation;

(3) to provide an adjustable locking tool wherein the adjusting, locking and unlocking operations can be done with just one hand; and (4) To provide an adjusting and locking tool where the spread of the handles at their most wide open position is restricted to the normal span of an average hand for gripping purposes.

Additional objects and advantages of my invention will become apparent from a consideration of the drawings and ensuing description of it, wherein a number of preferred embodiments are presented. It will be understood that the embodiments presented are for illustration purposes only and the invention is not necessarily limited to such, but may be adapted and used for any purpose for which it is found to be suitable.

DESCRIPTION OF THE PREFERRED EMBODIMENTS

Figure 1:
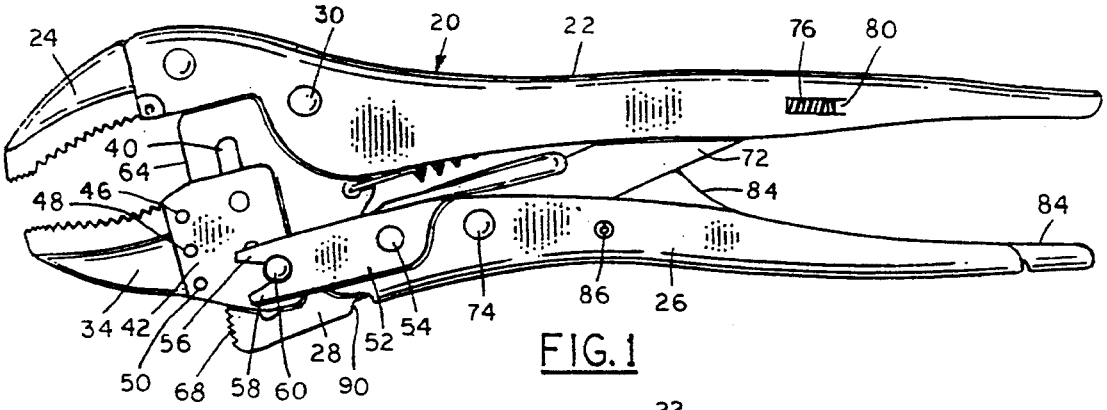
FIG. 1 is an elevational view as seen from one side of the tool.
Figure 2:
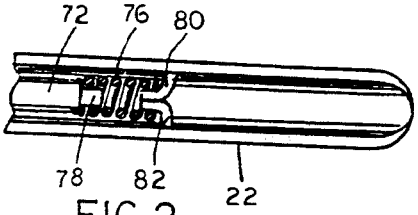
FIG. 2 shows a fragment, partly in section, of the outer end of the elongated handle as viewed from the bottom side.
Figure 3:
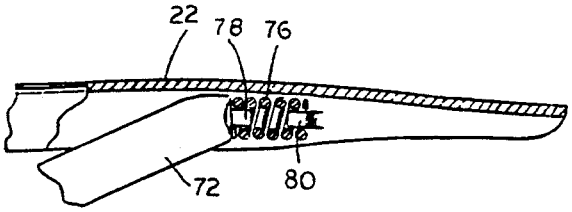
FIG. 3 is the same fragment shown in FIG. 2, partly in section, as seen from one side.

Referring to the corresponding numbers on the attached drawings, my invention is composed of the following:

FIGS. 1 through 5 show the tool 20 comprising the invention as having an elongated handle 22, a fixed jaw 24 attached to handle 22, a pivoting handle 26, a body 28 connected pivotably to both handles 22 and 26 by pivot pins 30 and 32 (32 not visible in FIG. 1), and an adjustable jaw 34 slidably mounted on body 28. Jaw 34 is attached to body 28 by two pins 36 and 38 which slide freely within an elongated slot 40 in body 28. The two pins 36 and 38 are connected to both sidewalls 42 and 44

Figure 4:
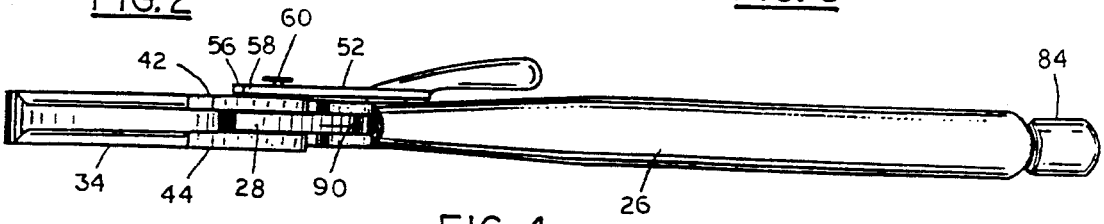
FIG. 4 is an elevation of the tool as shown in FIG. 1 rotated 90 degrees clockwise.
Figure 5:
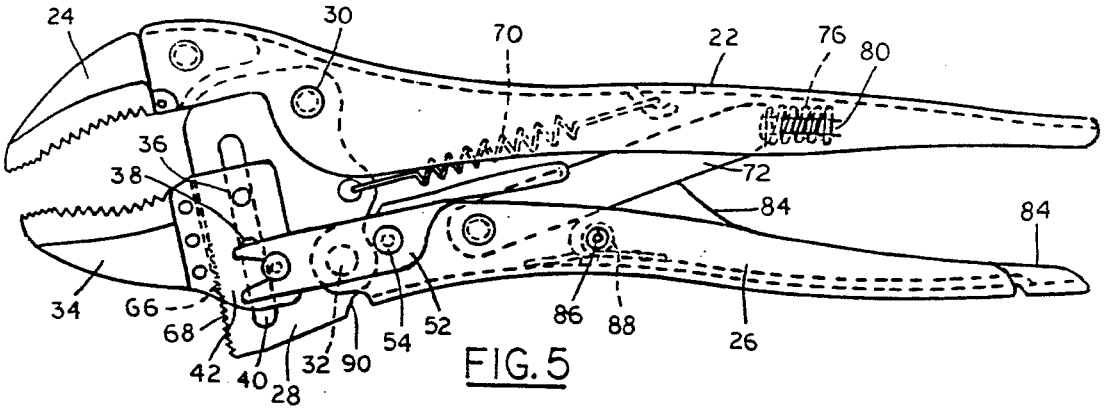
FIG. 5 is a plan view of the tool shown in FIG. 1.

(44 is visible only in FIG. 4). Pin 38 is somewhat smaller in diameter than the width of slot 40 so that jaw 34 may pivot on pin 36 so that serrations 66 may be lifted enough to clear serrations 68 during the adjustment of jaw 34. Sidewalls 42 and 44 are attached to jaw 34 by three pins or rivets, 46, 48, and 50, or by welding or braising. An adjusting lever 52 is pivotably attached to handle 26 by a pivot pin 54. The forward end of lever 52 is slotted and forms a yoke whose arms 56 and 58 are angled away from each other in the shape of a "V". Arms 56 and 58 straddle a pin 60 that is attached to the rear lower portion of jaw 34. The rear end of lever 52 is moved back and forth with the thumb of the hand holding the tool to slide jaw 34 along rail 64 toward or away from fixed jaw 24. The angle of arms 56 and 58 perform the function of lifting the rear end of jaw 34 the necessary distance to clear serrations 66 over serrations 68 during the movement of adjustable jaw 34 toward fixed jaw 24 when closing the jaws. When jaw 34 comes in contact with a work piece, it is tilted backward and engages serrations 66 with serrations 68, whereupon handles 22 and 26 are squeezed together to activate the locking action. Reversing the travel of adjustable jaw 34 with adjusting lever 52 to open the jaws produces the same lifting action to again clear the serrations on adjustable jaw 34 over the serrations on rail 64. A spring 70 is attached to body 28 at one end and to handle 22 at the other. A fulcrum bar 72 is pivotably connected at one end to handle 26 by a pivot pin 74 and at the other it butts up against an end of a very stiff spring 76 which is disposed internally in elongated handle 22. Spring 70 maintains the necessary tension between fulcrum bar 72, handle 26, and body 28 so that the toggle action that locks the jaws on an object will work. When handles 22 and 26 are pressed together, the fulcrum point at pin 74 is forced to pass between pivot points established by end 78 of fulcrum bar 72 and pin 32 that attaches pivoting handle 26 to body 28, thereby causing body 28 to pivot on pin 30. This pivoting action causes adjustable jaw 34 to move toward fixed jaw 24, producing the locking action on the work piece. In this instance, spring 76 is held in position within handle 22 by two inwardly projecting parts 80 and 82 in both sides of handle 22. Spring 76 performs a unique function in that a much wider range of travel for adjustable jaw 34 is possible in which a locking operation can be successfully completed. For example, in a locking tool having a screw as the adjusting means, the fulcrum bar is blocked by the screw which has no resiliency. Therefore, there is no movement of the fulcrum bar possible when both jaws are put into contact with a work piece, so the adjustable jaw has to be stopped just short of the work piece, leaving the clearance necessary for the toggle action to work and effect a locking of the jaws on the work piece. Because this clearance is so limited, it is the reason why locking tools having the screw adjustment must usually be adjusted several times before the proper clearance is obtained to lock the jaws. In the present invention, however, both jaws 24 and 34 (and their alternates) can be put into contact with a work piece and when handles 22 and 26 are squeezed together, fulcrum bar 72 can still travel far enough to permit the toggle action to work due to the compression of spring 76. If the adjustable jaw 34 is adjusted to where it is just lightly touching a work piece, a light grip will result; and if the adjustable jaw is pressed hard against a work piece, the serrations on jaw 34 will be moved forward another notch in the serrations on rail 64, thereby effecting a much stronger and tighter grip.

A lever 84 for unlocking jaws 24 and 34 is attached to pivoting handle 26 by pin 86. A spring 88 encircles pin 86 and is biased against lever 84 and handle 26 to hold lever 84 in operable position. When the outer end of lever 84 is pulled inward toward handle 22, the inner part of lever 84 pushes against fulcrum bar 72 and spreads handles 22 and 26 which unlocks jaws 24 and 34 and releases the tool from a work piece. A stop wall 90 on body 28 limits the pivot of Handle 26, keeping handles 22 and 26 within normal gripping range of each other.

Figure 6:
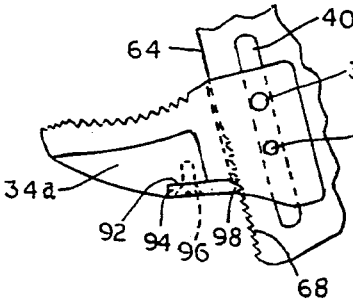
FIG. 6 is a plan view of an alternate adjustable jaw construction.

FIG. 6 shows an alternate preferred embodiment of adjustable jaw 34. Jaw 34*a* is shown as having a notch 92 cut or formed therein into which pawl 94 is attached with screw 96. It will be noted that in this embodiment pawl 94 has a single engaging tooth 98, although multiple serrations may also be used. It will also be noted that in this embodiment the sidewalls of jaw 34*a* are not separate and attached by pins or other means but are integral with the jaw. This makes the jaw much easier and cheaper to manufacture as a single unit because there are no internal teeth or serrations formed as a part of the jaw. Therefore, a straight cut can be made through the jaw to form the bifurcation.

Figure 7:
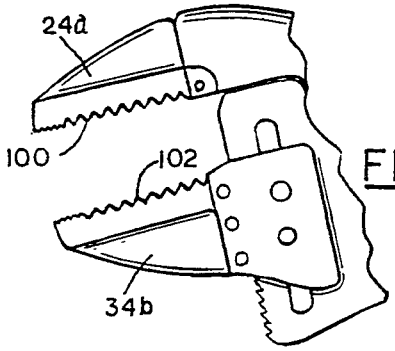
FIG. 7 is an elevation of a second alternate adjustable jaw configuration.

FIG. 7 shows a second alternate preferred jaw configuration wherein jaws 24*a* and 34*b* have straight serrated gripping surfaces 100 and 102.

OPERATION

To operate the tool, handles 22 and 26 are spread apart the maximum amount which opens jaws 24 and 34 to their maximum gap. The jaws are then placed around a work piece and adjusting lever is moved in a clockwise direction with the thumb of the hand holding the tool. This movement slides adjustable jaw 34 toward fixed jaw 24 until it contacts the work piece. As described previously herein, a light touch will result in a fairly light grip, and heavy pressure will result in a very tight grip, at the option of the operator. Handles 22 and 26 are then pressed together, locking the jaws on the work piece. To unlock the jaws, the little finger of the hand holding the tool pulls on release lever 84 which spreads handles 22 and 26 and releases the jaws from the work piece.

It is claimed:

1. An adjustable gripping and locking hand tool comprising:

a body pivotably attached to an elongated handle, a pivoting handle attached to said body, both of said handles being U-shaped in cross section, a fixed jaw on said elongated handle, an adjustable jaw on said body, a fulcrum bar disposed between said elongated handle and said pivoting handle, means for mounting said adjustable jaw on said body, and means for adjusting said adjustable jaw toward and away from said fixed jaw.

2. The hand tool of claim 1 wherein said means for mounting said adjustable jaw on said body comprises:

a bifurcated section in the lower portion of said adjustable jaw, said bifurcated section straddling said body, an elongated slot in paralleling an outer rail thereon, said adjustable jaw on said rail and held thereon by two pins disposed slidably within said slot and attached to the two sidewalls of said bifurcation.

3. The invention of claim 1 wherein said means for adjusting said adjustable jaw toward and away from said fixed jaw comprises:

an adjusting lever, means for linking said adjusting lever with said adjustable jaw, and means for attaching said adjusting lever to said pivoting handle.

4. The hand tool of claim 3 Wherein said means for linking said adjusting lever to said adjustable jaw is comprised of:

a yoke on one end of said lever wherein the arms of said yoke are spread in the form of a V, said arms straddling a pin, said pin being disposed freely between said arms of said yoke and attached to said jaw.

5. The invention of claim 3 wherein said means for attaching said lever to said pivoting handle comprises:

a retaining pin having a head on one end thereof, said head being somewhat larger in diameter than the stem of said pin, the other end of said pin extending freely through a hole in said lever where it is attached to said pivoting handle.

6. The hand tool of claim I wherein a coil spring is contained within said elongated handle in axial alignment therewith, the outwardly facing end of said spring being disposed up against inwardly extending arms on said handle, the inwardly facing end of said spring being in contact with and held in position by one end of said fulcrum bar, and the other end of said fulcrum bar being attached to said pivoting handle by a pivot pin.

7. In an adjustable gripping and locking tool, the combination of:

a body, an elongated handle and a pivoting handle attached pivotably to said body, both of said handles being of U-shaped cross section, a fixed jaw on said elongated handle, an adjustable jaw mounted on said body, a fulcrum bar disposed between said handles, means for attaching said adjustable jaw to said body, and means for moving said adjustable jaw toward and away from said fixed jaw.

8. The hand tool of claim 7 wherein said means for attaching said adjustable jaw to said body comprises;

a. a bifurcated section on the lower portion of said jaw, said bifurcated section straddling a rail section on said body;

b. an elongated slot in said body in substantially parallel alignment with said rail; and c. two pins attached to the sidewalls of said bifurcation and being disposed slidably through said elongated slot.

9. The invention of claim 7 wherein said means for moving said adjustable jaw toward and away from said fixed jaw comprises;

an adjusting lever, means for linking said lever with said adjustable jaw, and means for attaching said adjusting lever to said pivoting handle.

10. The invention of claim 9 wherein said means for linking said adjusting lever with said adjustable jaw comprises;

a yoke on one end of said lever, the arms of said yoke being spread in the form of a V, said arms straddling a pin, with said pin being disposed freely between said arms and attached to said adjustable jaw.

11. The invention of claim 9 wherein said means for attaching said lever to said pivoting handle comprises:

a retaining pin with an enlarged head on one end, the other end extending freely through said lever and attached to said pivoting handle.

12. The hand tool of claim 7 wherein a coil spring is disposed within said elongated handle in axial alignment therewith, the outwardly facing end of said spring being retained in place by inwardly projecting arms, the oppositely facing end of said spring contacting one end of said fulcrum bar and being held in position by a projecting knob on said bar inserted into said oppositely facing end of said spring, thereby providing the means whereby a lighter grip on a workpiece is obtained by lightly contacting said work piece with said adjustable jaw using said adjusting lever, or a heavier grip by pressing said adjustable jaw forcefully against said work piece with said adjusting lever, and then closing said handles to activate the locking mechanism.

13. In an adjustable gripping and locking tool having an elongated handle, a fixed jaw on said handle, an adjustable jaw attached to said elongated handle operated by a pivoting handle, a fulcrum bar, and an adjusting screw, wherein the improvement comprises;

different means for mounting said adjustable jaw on said tool, and different means for adjusting said adjustable jaw, both of said means resulting in a tool whereby it can be operated more quickly and efficiently with just one hand.

14. the tool of claim 13 wherein said means for mounting said adjustable jaw on said tool is comprised of;

a. a body disposed between said elongated handle and said pivoting handle and pivotably attached to said handles;

b. a bifurcated section on said adjustable jaw, said bifurcated section straddling said body;

c. an elongated slot in said body paralleling a rail section on which is mounted said adjustable jaw; and d. pins inserted slidably within said slot and attached to both walls of said bifurcated section on said adjustable jaw.

15. The tool of claim 13 wherein said means for adjusting said adjustable jaw comprises;

a. an adjusting lever, said lever being attached to said pivoting handle by a pivot pin;

b. a yoke on one end of said lever wherein the arms of said yoke are spread in the form of a V; and c. a pin attached to Said adjustable jaw, said pin being disposed freely between said arms of said yoke, whereby when said lever is moved clockwise, said adjustable jaw will be moved toward said fixed jaw until it contacts a work piece, and when said lever is moved in the opposite direction, said adjustable jaw will be moved away from said fixed jaw and said work piece.

* * * * *